United States Patent [19]

Loase

[11] 3,980,291

[45] Sept. 14, 1976

[54] MACHINE FOR FOLDING A CONTINUOUS WEB ASSEMBLY

[75] Inventor: Raymond M. Loase, Dayton, Ohio

[73] Assignee: Harris Corporation, Cleveland, Ohio

[22] Filed: Apr. 1, 1975

[21] Appl. No.: 564,119

Related U.S. Application Data

[63] Continuation of Ser. No. 118,047, Feb. 23, 1971, abandoned.

[52] U.S. Cl. ..... 270/73

[51] Int. Cl.[2] ..... B65H 45/16

[58] Field of Search ..... 270/6, 7, 13, 14, 19, 270/38, 39, 42, 47–50, 60, 63–65, 70–77

[56] References Cited

UNITED STATES PATENTS

| | | | |
|---|---|---|---|
| 1,200,211 | 10/1916 | Miller et al. | 270/39 |
| 3,083,010 | 3/1963 | Salmon et al. | 270/73 |
| 3,250,528 | 5/1966 | Loase | 270/73 |

*Primary Examiner*—Edgar S. Burr
*Assistant Examiner*—A. Heinz
*Attorney, Agent, or Firm*—Biebel, French & Nauman

[57] ABSTRACT

A continuous web folder includes a pair of driven cylinders arranged in adjacent parallel relation, and each cylinder has a pair of diametrically opposed movable jaw members disposed at right angles to a pair of diametrically opposed pivotal tucker blades. The surface of each cylinder includes axially spaced circumferentially extending wide grooves which form relatively narrow circumferentially extending ribs therebetween for effectively eliminating the effect of static electric attraction between the cylinders and a paper web directed between the cylinders and thereby provides for high speed zig-zag folding of the web.

1 Claim, 3 Drawing Figures

INVENTOR
RAYMOND M. LOASE
BY
Marechal, Biebel, French & Bugg
ATTORNEYS

MACHINE FOR FOLDING A CONTINUOUS WEB ASSEMBLY

RELATED APPLICATION

This application is a continuation of application Ser. No. 118,047, filed Feb. 23, 1971, now abandoned.

BACKGROUND OF THE INVENTION

In a machine for folding a continuous web assembly in a zig-zag manner, such as disclosed in Loase U.S. Pat. No. 3,250,528 which issued to the assignee of the present invention, the web assembly is directed downwardly between a pair of parallel adjacent rotary cylinders each of which carries a pair of diametrically opposed movable creasing jaws arranged at 90° to a pair of diametrically opposed movable tucker blades. The movable jaws and tucker blades on the cylinders cooperate in an alternating manner to crease and fold the continuous web assembly in a zig-zag manner. Commonly, each fold of the web assembly defines a multiple copy business form assembly, and longitudinally spaced lines of cross perforations are provided within the web assembly to facilitate separating of the business forms after they are processed through a business machine.

It has been found desirable for a zig-zag folding machine to incorporate folding cylinders rather than a pair of folding mechanisms as disclosed in Loase U.S. Pat. No. 2,819,068. That is, the cylinder-type construction has been found more economical both in materials and assembly and also assures that the web folds outwardly away from the outer surfaces of the cylinders instead of inwardly into the rotating folding mechanisms.

It has also been found that when a cylinder folding machine is operated at a relatively high speed for rapidly folding a web assembly, as for example, at a speed of approximately 1000 feet per minute, there is a tendency for each fold of the web assembly to cling to or adhere to the outer cylindrical surface of the adjacent cylinder. This attraction is caused primarily by static electric charges created between the folding cylinders and the web assembly and frequently results in the folds being curled or rolled as they are being stripped or released from the cylinders by adjacent stripping members or pins. As a result of the rolling or curling of the web folds, the overlapping webs are prevented from flowing smoothly and uniformly from the folding cylinders, and occasionally the curled folds will collect and jam the machine.

SUMMARY OF THE INVENTION

The present invention is directed to an improved folding machine of the general type disclosed in the above Loase U.S. Pat. No. 3,250,528 and which is especially desirable for zig-zag folding a web assembly at relatively high speeds, for example, over 800 feet per minute. The folding machine of the present invention particularly provides for effectively eliminating static electric attraction between the folded web assembly and the folding cylinders so that the overlapping folds of the web assembly flow smoothly and uniformly from the folding cylinders onto a receiving conveyor or into a receiving chamber. Furthermore, the effect of static electric attraction is effectively eliminated without adding any significant cost to the production of the folding machine.

In accordance with a preferred embodiment of the invention, the outer cylindrical surface of each folding cylinder is provided with a plurality of axially spaced circumferentially extending wide grooves which form relatively narrow circumferentially extending ribs between the grooves. The ribs have a uniform outer diameter to assure that the web folds flex outwardly away from the folding cylinders. On the other hand, the depth and width of the grooves are effective to reduce substantially the area of the outer surface of the cylinders in contact with the web assembly, thereby reducing the static electric attraction between the folding cylinders and the web folds to essentially a negligible or insignificant level. In addition, the grippers and/or tucker blades extending across the cylinder form end walls of the recesses, and the lengths of web held against the outer cylinder surface during folding operations trap air within the closed recesses. When the grippers release these lengths of web, the trapped air assists in urging the web away from the outer cylinder surface. As a result, the folding operation can be performed at a relatively higher speed without the collected overlapping folds curling or rolling and jamming the machine.

Other features and advantages of the invention will be apparent from the following description, the accompanying drawing and the appended claims.

DESCRIPTION OF THE PREFERRED EMBODIMENT

Figure 1:
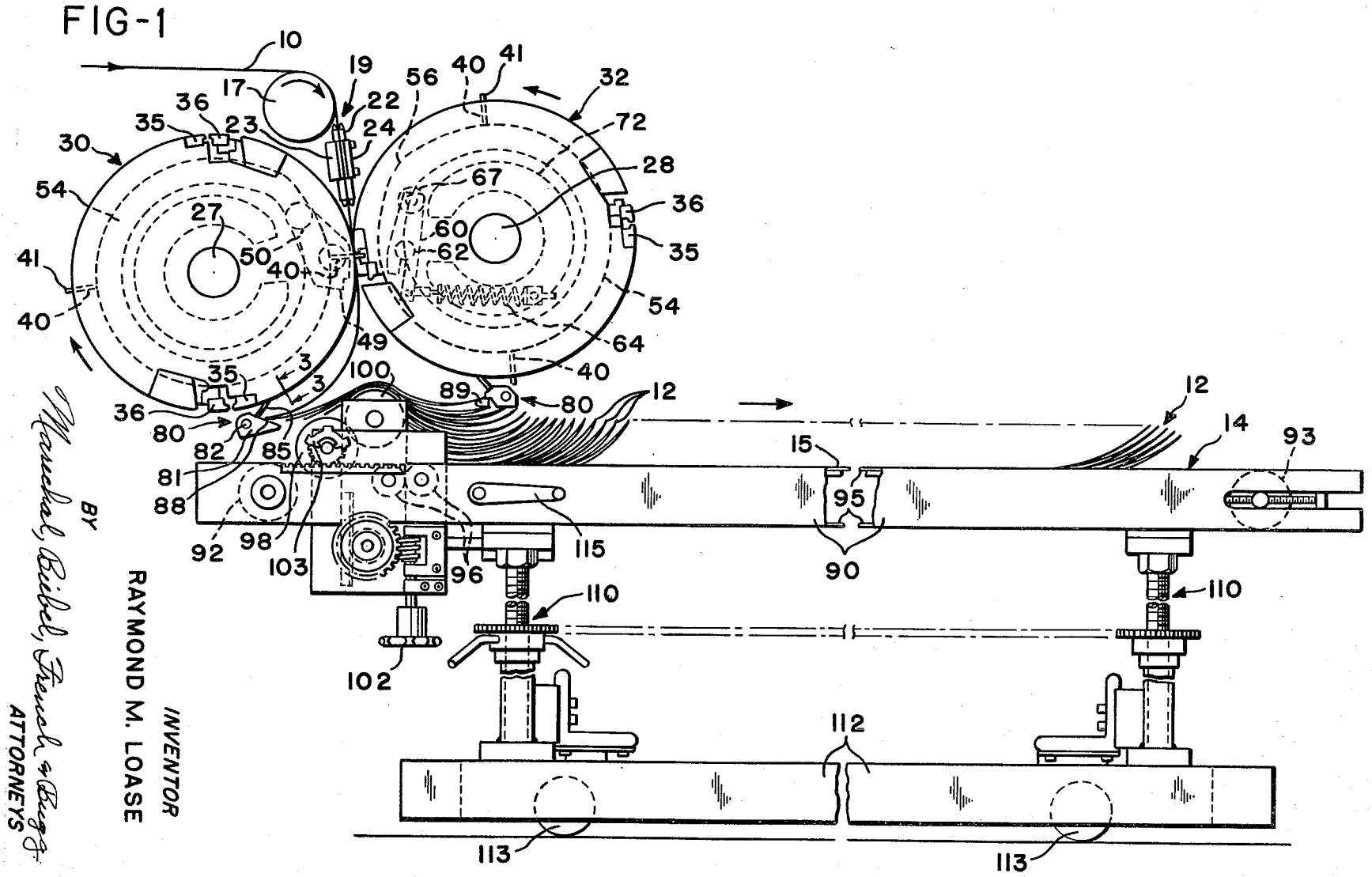
FIG. 1 is a somewhat schematic elevational view of a web folding apparatus constructed in accordance with the invention.

Referring to the drawings, FIG. 1 shows, somewhat schematically, a folding machine constructed in accordance with the invention and through which a paper web 10 is fed to produce continuously connected folds 12 which are folded in a zig-zag pattern and are delivered along the top of a delivery table 14. As also shown in the above Loase U.S. Pat. No. 3,250,528, the web 10 of paper enters the folding machine in the upper left-hand corner as it is received from a printing press, or the like, and is directed over a power driven roller 17 downwardly into a feed chute 19. It is to be understood that reference to a web is intended to include several webs which are overlaid on top of one another, as is commonly used to form multiple copy business forms. As mentioned above, it is also common to provide the web with uniformly spaced perforations which extend transversely across the web and serve the purpose of allowing one form to be easily separated from an adjoining form.

The feed chute 19 includes a series of rods 22 which are positioned in a staggered relationship at an angle slightly from vertical. The rods are retained by the bars 23 and 24 which are mounted at the end to the main side frames (not shown) of the folding apparatus. Typically, the side frames may be extensions from the printing press, collator, or the like. The feed chute 19 is constructed to cause a slight corrugated effect in the web (across its length) in order to provide the web 10 with linear rigidity as it is directed into the folding apparatus.

Fixed to the parallel arranged shafts 27 and 28, which are rotatably mounted within the side frames, are a pair of folding cylinders 30 and 32 which are spaced substantially adjacent each other and which are power driven in timed relationship so that the surface speed of the cylinders is the same as the speed of the web 10. Mounted longitudinally and diametrically opposite on each cylinder are grippers in the form of two pairs of folding jaws 35 and 36 which are constructed to open and close as the cylinders 30 and 32 are counter rotated by a suitable power source (not shown).

Spaced 90° from the folding jaws 35 and 36, on each of the cylinders 30 and 32, there is mounted a pivotable tucker blade 40 having a tip 41. The blade tip 41 is adapted to engage the web 10, and tuck a small portion of the web in between the folding jaws 35 and 36 mounted on the opposite cylinder when the folding jaws are in the open position. The tucker blades 40 are mounted substantially radially within corresponding rods 42 which are positioned within the cylinders 30 and 32 parallel to the shafts 27 and 28. Each rod 42 is adapted to rotate slightly, as the cylinders 30 and 32 rotate, by a lever 49 which is clamped over the end of the rod 42 and which carries on one end a roller 50 that follows within a box cam 54 which is stationarily mounted on the side frame at the end of each cylinder. The box cam 54 is circular in shape except for the rise 56 near the top of the cam.

When the left cylinder 30 rotates clockwise, the roller 50 reaches the rise 56 in the box cam 54 causing the lever to rotate clockwise. The rise 56 in the box cam is so positioned that the tip 41 of the tucker blade 40 will advance clockwise, ahead of the surface of the cylinder 30, immediately before the tip of the tucker blade 40 picks up the web 10 coming from the feed chute 19. As the blade tip 41 picks up the web 10, the box cam 54 is so formed that the tip 41 of the tucker blade 40 will begin to move counterclockwise in relation to the folding cylinder 30. As the blade tip 41 tucks a small portion of the web 10 into the open jaws 35 and 36, the peripheral speed of the blade tip 41 will be precisely the same as the speed of the web 10. Otherwise, since the surface speed of the cylinder 30 is the same as the web speed, if the blade 40 did not retract by rotating counterclockwise as it picks up the web, the speed of the blade tip 41 would be faster than the web speed due to the fact that the tip of the tucker blade extends radially outward from the surface of the cylinder.

The timed retraction of blade tip 41 enables it to follow and remain in a precise engaged relationship with the row of cross perforations as the web 10 is pushed into and around the jaw edge, thus requiring that the blade tip 41 travels slower than the folding jaws 35 and 36, after the tip picks up the web.

As the cylinders 30 and 32 continue to rotate to the position shown in FIG. 1, the folding jaws 35 and 36 are closed tightly on a small portion of the web 10 which has been inserted within the jaws 35 and 36 by the tucker blade 40. This closing of the jaws is accomplished by the slight rotation of a lever 60 which is mounted on one end of the rod 62 which, in turn, supports the movable jaw 36. A compression spring 64 holds the jaws tightly closed after a roller 67, carried by the lever 60, drops off the circular outer surface of a C-shaped cam 72 which is also mounted to one of the side frames of the folding apparatus.

Since both of the cylinders 30 and 32 contain two pairs of folding jaws 36 and 35 and two tucker blades 40, each of the cylinders 30 and 32 requires both a box cam 54 and a C-shaped cam 72 in order to control the pivoting movements of the movable folding jaw 36 and the tucker blade 40. Preferably, the cams 54 and 72 are adjustably mounted on the side frames (not shown), in order to acquire the precise timing and spacing as the tucker blades 40 enter the folding jaws 35 and 36.

In accordance with the present invention, the outer surface of each of the cylinders 30 and 32, is formed with a plurality of axially spaced and circumferentially extending wide grooves or recesses 75 (FIG. 3) which define therebetween a corresponding plurality of axially spaced and circumferentially extending narrow ribs 76 having outer cylindrical surfaces 78 of the same diameter. Each of the circumferential recesses 75 has an axial width of approximately two inches and a depth of approximately 0.445 inch. The bottom surface of each recess 75 curves upwardly to the outer surface 78 of the adjacent ribs 76.

Figure 3:
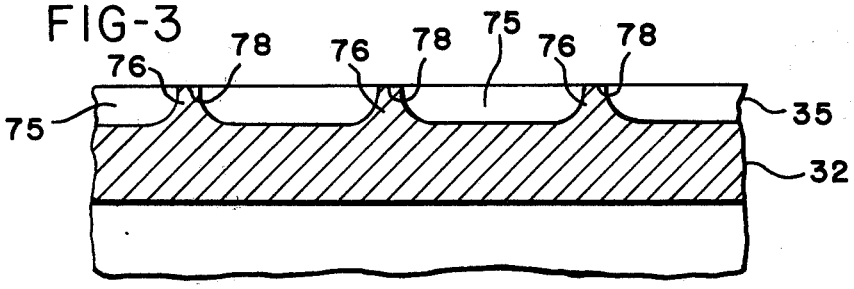
FIG. 3 is an enlarged fragmentary section taken generally on the line 3—3 of FIG. 1.

The recesses 75 are spaced axially so that the outer surfaces 78 of the ribs 76 have a relatively narrow axial width of approximately 0.250 inch. Thus the axial width of each recess is approximately five times the axial thickness of each rib and approximately four times the radial depth of each recess which is approximately two times the axial thickness of each rib. As illustrated in FIG. 3, the alternating recesses 75 and the relatively narrower ribs 76 cooperate to provide each of the cylinders 30 and 32 with a somewhat scalloped cross-sectional configuration.

Also mounted on the side frames of the folding apparatus and spaced adjacent the bottom portion of the cylinders 30 and 32, are a pair of stripping members 80 which are adapted to engage the edges of the folds 12 and release the edges from between the folding jaws 35 and 36 which have been opened by the cam 72 slightly before the folding jaws reach the stripping members 80. Each stripping member 80 includes an elongated bar 81 which is adjustably mounted on a rod 82 having ends secured to the side frames of the apparatus. Projecting upwardly from the elongated bar 81 are a series of laterally spaced stripping pins 85 which extend into the corresponding grooves or recesses 75 formed within the outer surfaces of the cylinders 30 and 32. The upper ends of the pins 85 are cut on a sharp angle so that the pins will readily engage the edges of the folds 12 and will cam the edges downwardly along the pins onto the elongated bar 81. The left bar 81 (FIG. 1) has a sloping surface 88, and the right bar 81 includes a rounded nose 89 which allows the folded edge to drop smoothly off the bar. The folding jaws and tucker blades have narrow slots (not shown) to pass the tips of pins 85 in known manner.

The table 14 which receives the zig-zag continuous folds 12, is disclosed in detail in the above Loase U.S. Pat. No. 3,250,528. In general, the table 14 includes a horizontally extending frame 90 which supports on opposite ends a pair of rollers 92 and 93. A plurality of laterally spaced endless belts 95 are directed around the end rollers 92 and 93 and are also directed upwardly around a set of guide rollers 96 and 98 and a laterally extending roller 100 positioned directly below the cylinders 30 and 32 for supporting the folds 12 as they are released from the cylinders by the stripping members 80. As described in the above patent, the roller 100 is adjustable both vertically and horizontally relative to the frame 90 by turning respective adjustment knobs 102 and 103. The frame 90 of the table 14 is supported by a set of screw jacks 110 which are mounted on a base platform 112 supported by a set of casters or wheels 113. The jacks 110 are adjustable by turning a hand crank 115 for moving the entire table 14 and the roll 100 vertically as a unit relative to the cylinders 30 and 32.

Figure 2:
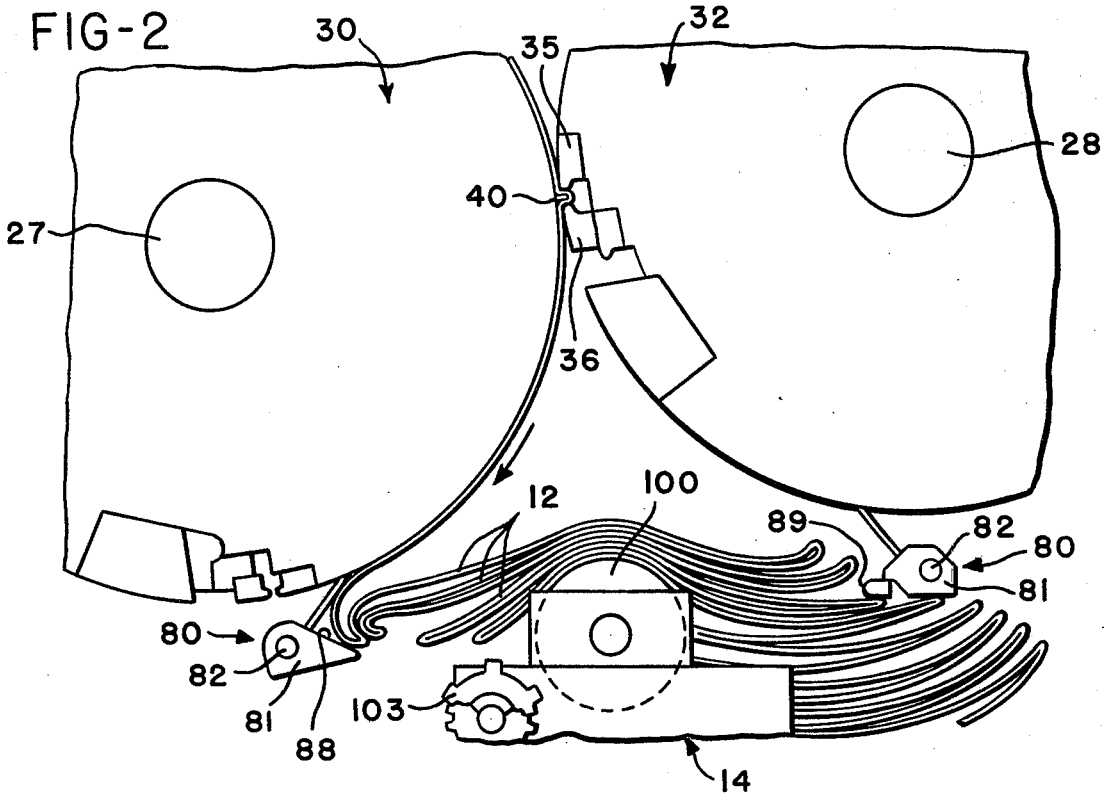
FIG. 2 is an enlarged fragmentary view of a prior art folding machine illustrating the curling and rolling problem which develops during high speed operation.

FIG. 2 illustrates the problem occasionally encountered during operation of a folding machine as disclosed in the above Loase U.S. Pat. No. 3,250,528. That is, when such a machine is operated at a high speed, a static electric charge is created between the assembled web 10 and the outer cylindrical surface of each of the folding cylinders. The static charge caused the folds 12 to adhere to the outer cylindrical surfaces of the cylinders instead of flexing outwardly away from the cylinders as shown in FIG. 1. As a result, the lower edge portions of the folds would roll or curl inwardly toward the roller 100 thereby preventing the folds from lying flatly one on top of the other.

This problem of curling and rolling of the folds is eliminated by a folding machine constructed in accordance with the present invention. That is, by providing the axially spaced circumferential grooves or recesses 75 within the outer surface of each folding cylinder 30 and 32, the static electric attraction between the web folds 12 and the folding cylinders is substantially eliminated. As a result, the folds flex outwardly away from the folding cylinders when the lower edges of the folds engage the stripping members 80. Thus each fold 12 is immediately laid on the receiving roller 100 so that the folds flow smoothly and uniformly from the folding cylinders and outwardly on the table 14 by the conveyor belts 95. The ribs 76 are effective to assure that each fold 12 flexes outwardly away from the corresponding cylinder as shown in FIG. 1, when the lower edges of the fold engages the stripping members 80. Preferably, the center portion of each folding cylinder 30 and 32 between the circular end plates (not shown), is cast in two semi-cylindrical sections. Thus the ribs 76 can be conveniently cast within the cylinder wall to avoid an operation of machining the circumferential recesses 75 within the folding cylinders.

As is apparent from FIG. 1 and FIG. 3, since the folding jaws 35 and the tucker blades 40 project radially outwardly through the circumferential recesses 75 within the outer surfaces of the folding cylinders, the folding jaws 36 and blades 40 are also effective to trap air within the recesses 75 as the web is fed through the nip of the folding cylinders. Thus the folding cylinders 30 and 32 function also as blowers to blow air downwardly through the nip. Thus trapped air is effective to aid in separating the web folds 12 from the outer surfaces 78 of the ribs 76 on the folding cylinders.

While the form of apparatus herein described constitutes a preferred embodiment of the invention, it is to be understood that the invention is not limited to this precise form of apparatus, and that changes may be made therein without departing from the scope of the invention which is defined in the appended claims.

What is claimed is:

1. In a high speed cylinder type folder for folding a continuous web in zig-zag fashion, said folder including a pair of driven cylinders mounted with their axes of rotation in parallel adjacent relation and each having an outer cylindrical wall defining a nip adapted to receive the web therebetween, grippers and tucker blades mounted in diametrically opposed positions in said walls lengthwise of each said cylinder, the gripper on one cylinder being arranged in opposed cooperating relation with the blade on the other cylinder whereby said blades tuck the web into said grippers on alternate ones of said cylinders at longitudinally spaced intervals along the web in response to rotation of said cylinders, said grippers being controlled such that lengths of said web are pulled away from said nip and held by said grippers in contact with portions of the associated said outer cylindrical walls of first one and then the other of said cylinders before release of said grippers, and stripping members operative to guide the folded web from said cylinders upon release of said grippers;

the improvement comprising said portions of said outer walls having formed therein a series of spaced apart relatively wide and shallow recesses opening outwardly in a circumferential direction around each said cylinder and having bottoms slightly depressed with respect to said outer cylindrical walls, said recesses being separated by relatively narrow ribs having outer surfaces which are adapted to contact the web and having sides integral with the bottoms of said recesses the width of said recesses being substantially greater than the width of said ribs, said grippers and tucker blades extending lengthwise of said cylinders across said recesses and ribs to form end walls of said recesses extending outward to the level of said outer cylindrical walls and thereby to trap air in said recesses behind said lengths of said web whereby upon release of said grippers the lengths of web will be urged away from said cylinders by the trapped air.

* * * * *